US005302050A

United States Patent [19]

Buckenauer et al.

[11] Patent Number: 5,302,050

[45] Date of Patent: Apr. 12, 1994

[54] DEVICE FOR BRIDGING EXPANSION JOINTS IN BRIDGES OR THE LIKE

[75] Inventors: Günter Buckenauer, Baldham; Christian Braun, Holzkirchen, both of Fed. Rep. of Germany

[73] Assignee: Friedrich Mauerer Söhne GmbH & Co. KG, Munich, Fed. Rep. of Germany

[21] Appl. No.: 860,084

[22] Filed: Mar. 30, 1992

[30] Foreign Application Priority Data

Apr. 29, 1991 [EP] European Pat. Off. ..... 91106926.8

[51] Int. Cl.[5] ..... E01C 11/02; E01F 13/00

[52] U.S. Cl. ..... 404/53; 404/56; 52/396.06; 14/62; 14/64

[58] Field of Search ..... 404/47, 52, 53, 56; 14/57, 62-63, 16; 52/573; 403/52 M

[56] References Cited

U.S. PATENT DOCUMENTS

| | | | |
|---|---|---|---|
| 3,797,952 | 3/1974 | Pommerening | 52/573 X |
| 3,904,304 | 9/1975 | Honegger | 404/52 X |
| 4,030,156 | 6/1977 | Raymond . | |
| 4,050,207 | 9/1977 | Bertshmann et al. | 52/573 X |
| 4,516,284 | 5/1985 | Huber et al. | 404/56 X |
| 4,557,082 | 12/1985 | Dunsworth | 52/573 X |
| 4,566,143 | 1/1986 | Honegger et al. | 404/54 X |
| 4,674,912 | 6/1987 | Buckenauer | 52/573 X |
| 5,058,350 | 10/1991 | Mochiki et al. | 404/52 X |

*Primary Examiner*—Peter R. Brown
*Assistant Examiner*—Nancy P. Connolly

[57] ABSTRACT

A device for bridging expansion joints in bridges or the like is provided with parallel lamellae arranged at right angles to the longitudinal axis of the traffic route. The lamellae are supported on at least two inclined traverses which are pivoted and movably supported at both sides in the joint edges, which bridge said joint diagonally with respect to the longitudinal axis, and are rotatably and movably guided in sliding drag bearings at the bottoms of the lamellae. The inclined traverses are arranged parallel to each other, whereby the support width of the lamellae is always uniform. At least one longitudinal traverse which is movably connected the longitudinal direction with each lamellae via sliding bearings fixed at the bottoms of the lamellae is provided for, preferably at the edge, for taking up the forces which inevitably occur due to movements of the bridge superstructure.

21 Claims, 4 Drawing Sheets

DEVICE FOR BRIDGING EXPANSION JOINTS IN BRIDGES OR THE LIKE

FIELD OF THE INVENTION

The invention relates to a device for bridging expansion joints in bridges or the like, said device comprising lamellae extending at right angles to the longitudinal axis of the traffic route and being supported on traverses which are pivoted and/or movably supported in the joint edges and bridge the joints.

BACKGROUND OF THE INVENTION

The prior art as disclosed in German Patent Document No. DE 27 46 490 C3 discloses a bridging device for expansion joints in which lamellae extending at right angles to the longitudinal axis of the traffic route are supported on traverses which are pivoted and movably supported at both sides in the joint edges and which diagonally bridge the joint. U-shaped bows are welded to the bottom of the lamellae, wherein elastic sliding drag bearings which are slewably connected with the lamellae and in which the traverses are movably guided are arranged in said U-shaped bows. In order to take up the horizontal force components occurring in the lamellae during the movement of the bridge superstructure, the traverses are alternately diagonal to each other. Thereby, the force components of the horizontal forces which are directed in the longitudinal direction of the lamellae neutralize each other so that there is no danger of a one-sided drifting of the lamellae.

The fact that the support distances of the lamellae are not uniform in this known construction has proven to be a particular disadvantage. As a result, a complicated reinforcement of the lamellae is required at those places in which the distances are larger in order to ensure the required flexural strength for loads occurring, for example, in heavy vehicle traffic. If the superstructure moves due to temperature influences, such as a creeping or contraction of the concrete, the traverses twist about a vertical axis. Due to the swivel, and traverses being arranged at an acute angle to the direction of movement of the superstructure, the angle between the swivel traverse and the direction of the lamellae or the two joint edges, respectively, changes when the joint gap is increased or reduced in size.

SUMMARY OF THE INVENTION

It is, therefore, the main object of the present invention to provide for a device of a simple design for bridging expansion joints, wherein the lamellae are supported by the traverses at uniform distances and the force components resulting from the movements of the superstructure as well as from the traffic loads are securely taken up.

According to the present invention, the object is solved by a device comprising the features of claim 1.

According to the present invention, the control forces are transmitted via the diagonal inclined traverses if there is a change in the joint width. The parallel arrangement of the inclined traverses therein guarantees a uniform support distance, so that a reinforcement of the lamellae is not required. Horizontal control forces which result from movements of the bridge superstructure generate force components in the longitudinal direction of the lamellae due to the parallel arrangement of the inclined traverses. Said force components are taken up by at least one additional traverse in the form of a guide traverse which is preferably disposed at the edges and may be arranged in the direction of displacement of the superstructure or diagonally, in particular opposite to the direction of the inclined traverses.

The guide traverse may therein also have the function of a moulding traverse which is required as a vertical support for the lamellae at both ends of the joint construction and which constitutes a guide for the lamella ends, so that the lamella ends are prevented from being vertically displaced to the upside.

An additional control mechanism is provided for ensuring that the lamellae do not jam at their protruding ends with which they are supported on the guide traverse, wherein the control forces of said control mechanism counteract the frictional forces resulting from the lamellae control force components acting in the longitudinal direction of the lamellae. This control mechanism may consist in advantageous manner of elastic control springs disposed in the area of the guide traverse or guide traverses, respectively. The control forces are therein arranged laterally between the lamellae and counteract the frictional forces. The control mechanism, however, can also consist of a rod control.

If there are not any additional control forces acting on the protruding lamella ends supported on the guide traverse, it is suitable to design the protruding lamella ends in such a manner that they are horizontally resistant to bending, as otherwise a horizontal deflection of the lamellae and thus a jamming of the guide traverse might occur. However, it is advantageous to provide for additional guide means at the lateral faces of the guide traverse as well as at the protruding lamella ends, wherein such guides may be in the form of thrust sliding bearings which are arranged in a U-shaped bow at the bottom of the respective lamella at both sides of the guide traverse. In order to improve the sliding behaviour between the thrust sliding bearing and the guide traverse, the side faces thereof are provided with sliding layers which may, for example, consist of sheet steel. The contact surfaces of the thrust sliding bearings may furthermore be coated with PTFE. Due to the additional thrust bearings, considerable forces which act in particular in the case of large road widths in the longitudinal direction of the joints and which are not taken up by the inclined traverses are securely taken up by the guide traverse. In the case of very large joint lengths and due to the alternating directions of the longitudinal forces, it may also be advantageous to provide for a second guide traverse at the opposite road edge so that smaller forces are transmitted to the guide traverse. In this case, it may prove to be advantageous that the thrust sliding bearings are only provided for on the outside of the guide traverse.

In order to ensure that the forces distribute evenly into the lamellae and are taken up by the guide traverse when the superstructure is moved, at least one thrust sliding bearing is provided for each support point lamella/guide traverse. Furthermore, a means preventing vertical displacement of the protruding end of the lamella is arranged between the guide traverse and the respective lamella. This means can consist of sliding bearings arranged at the top and the bottom of the guide traverse in a bow underneath the lamella, in particular a thrust sliding bearing the top of which is provided with the guide traverse and the bottom with encompassing guide ledges in such manner that the support in connection with the guide traverse prevents the lamella from lifting upwards.

As was mentioned earlier, such means may be provided at the two opposing sides of the protruding lamella ends, but it is also possible to provide for a guide traverse on one edge side and for a moulding traverse on the opposing edge side, both preventing the lamella ends from lifting in a vertical direction when they are designed as described.

BRIEF DESCRIPTION OF THE DRAWINGS

Further features, advantages and details of the invention can be taken from the following description of a preferred embodiment with the aid of the figures. Therein

DETAILED DESCRIPTION OF THE PREFERRED EMBODIMENTS

Figure 1A:
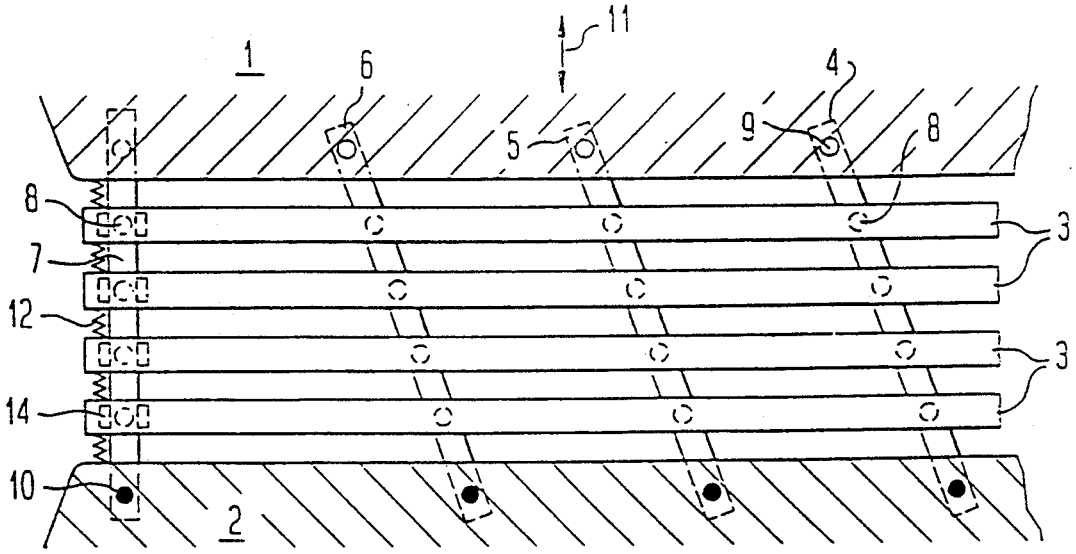
FIG. 1*a* is a schematic top view of a bridging device according to the invention with an open joint gap.
Figure 1B:
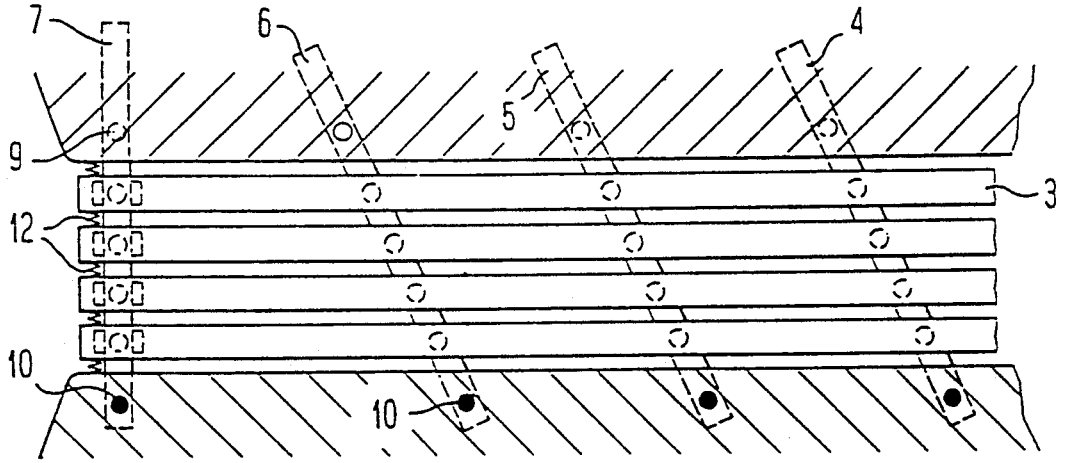
FIG. 1*b* is a top view in accordance with FIG. 1*a* with a half-open joint gap.
Figure 1C:
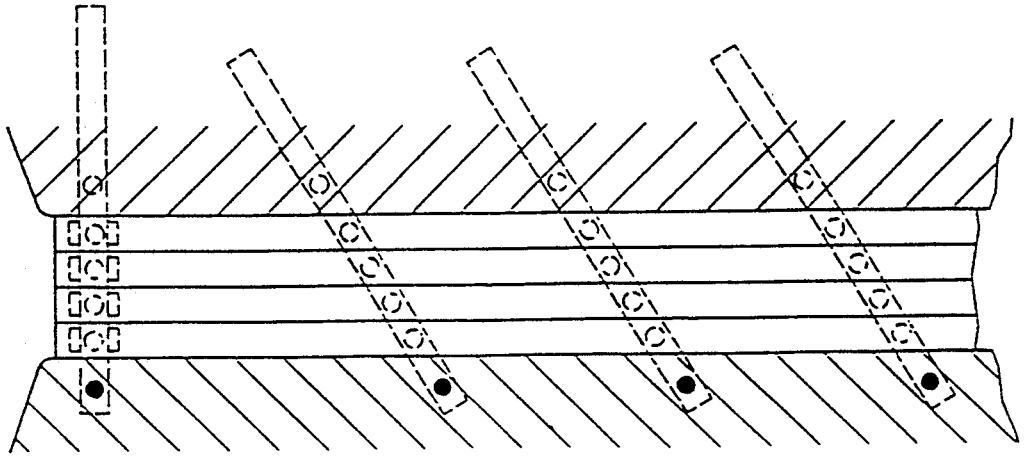
FIG. 1*c* is a top view in accordance with FIG. 1*a* with a closed joint gap in which the lamellae are close together.

According to FIGS. 1*a* to *c*, four lamellae 3 are arranged between the joint edges 1, 2 in the direction of the joint, i.e. the transverse direction, for bridging a joint. Whereas the joint edge 1 is defined by the bridge, the joint edge profile 2 defines the stationary abutment. The lamellae 3 are supported on a series of inclined traverses 4, 5, 6 which are parallel to each other and only three of which have been shown for reasons of clarity, as well as an edge-side guide traverse 7 arranged in the direction of movement of the superstructure 1, i.e. at right angles to the lamellae 3.

The lamellae 3 are supported via sliding drag bearings 8 on the inclined traverses 4, 5, 6 which for their part are supported in recesses of the joint edges via sliding drag bearings 9. The lower ends according to FIG. 1*a* of the inclined traverses 4, 5, 6 as well as the guide traverse 7 are fixed in the edge profile 2 by way of drag bearings 10. As the direction of the guide traverse 7 corresponds to the direction of movement 11 of the superstructure 1, it is also possible to use a simpler, rigid bearing instead of the drag bearing 10.

Figure 7:
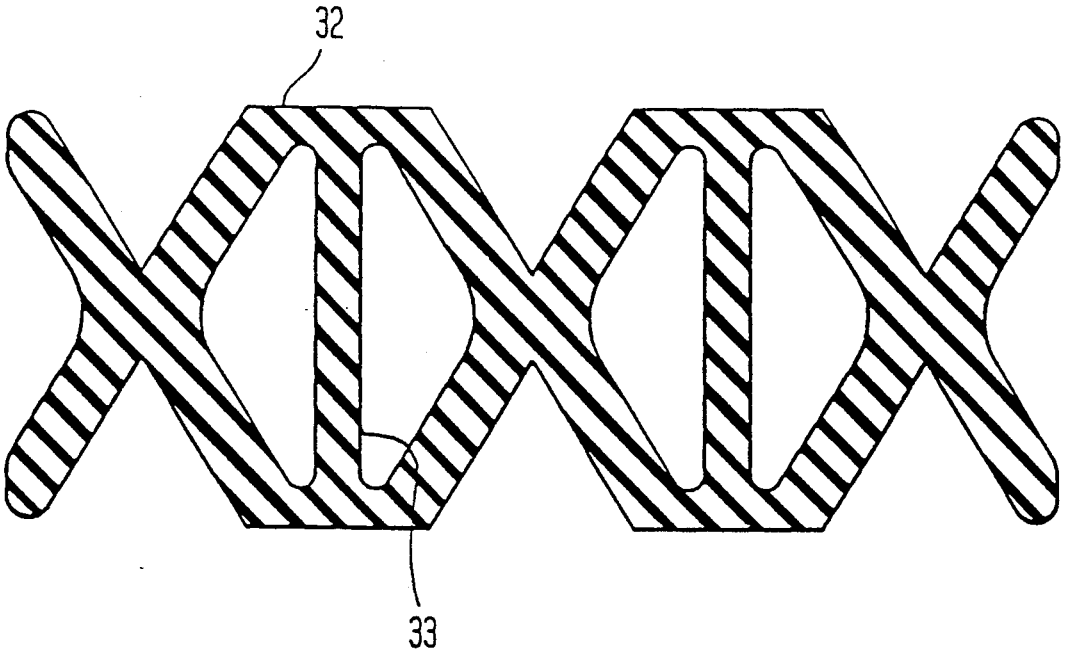
FIG. 7 is a sectional view of an embodiment of a control spring.

In the area of the guide traverse 7, control springs 12 are arranged in gaps between the lamellae 3 and between the lamellae and the joint edges for ensuring that a uniform lamellae distance is set even in the area of the guide traverse when there is a change in the joint width. These control springs are in the form of pressure springs and consist of polyurethane foam or a similar material. The spring design according to FIG. 7, i.e. in the form of a dual seal tube 32 having an inside ribbing 33 and being made of a material such as chloroprene, wherein the spring exerts spring forces due to the folding mechanism of the tube wall and the inside ribbing, has proven to be especially suitable. Due to the variable length of said tube spring 32, the spring forces can be adapted to the respective requirements. In the remaining area of the joint, the control forces for displacing the lamellae are generated by the diagonal inclined traverses, so that no elastic control elements are required for this purpose. The edge-side control springs 12 thus only serve for adjusting the lamellae in the area of the guide traverse 7 in order to prevent the protruding lamella ends from bending in this area due to control movements.

The adjustment of the lamellae in the case of a change of the joint width can be seen from FIGS. 1*a* to *c*. Since the pivots of the sliding drag bearing 8 relative to the lamellae are fixed, a change of the joint width inevitably results in an avertence or displacement of the inclined traverses 4, 5, 6 relative to the lamellae 3 which are always parallel to each other as well as in a displacement on the guide traverse 7.

Figure 2:
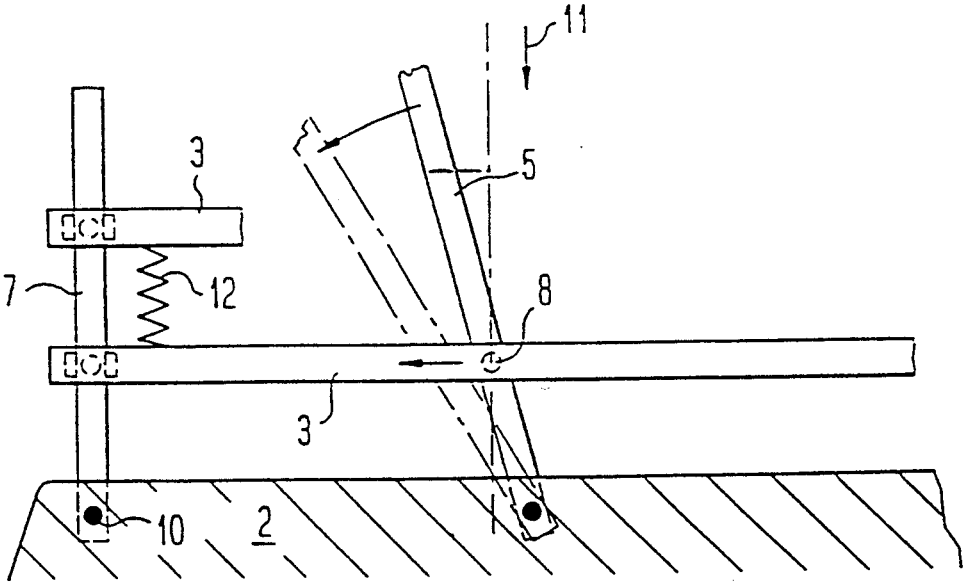
FIG. 2 is a schematic illustration of the interrelation of forces during the movement of a lamella towards the edge profile.

As can furthermore be clearly seen from FIGS. 1*a* to *c*, the angle of the inclined traverses which for their part remain parallel to each other during a movement of the superstructure 1 relative to the lamellae changes, so that in the longitudinal direction of each laella a control force is generated which has to be taken up at the guide traverse 7. These relations are shown for a guide traverse 7 in FIG. 2, in which the guide traverse means is parallel to the direction of movement 11 of the superstructure 1. Therein, the slewable support of the lamellae on the guide traverse or guide traverses, respectively, in the joint edges can be dispensed with. If the course of the guide traverse means differs from the direction of movement of the superstructure 1, the lamellae must be slewably supported on the guide traverse and the guide traverse itself must be rotatably guided in both joint edges. The advantage of this arrangement is in the lamella and guide traverse supports being prevented from jamming in the event of additional joint movements. Control forces are generated at the lamella or support points, respectively, during joint movements.

Figure 3:
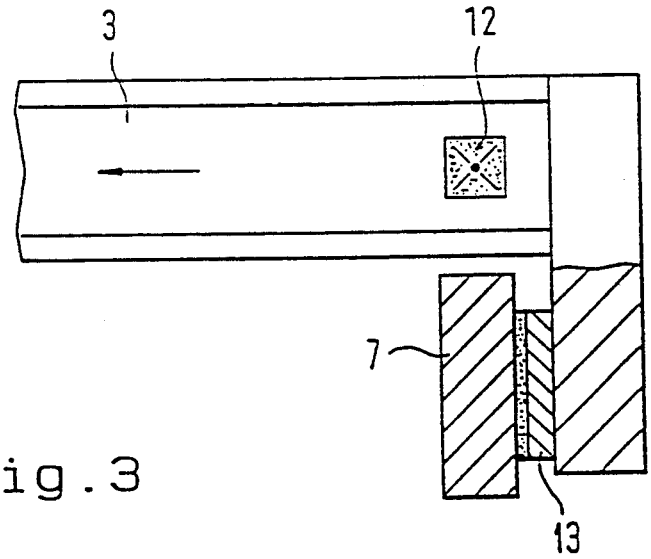
FIG. 3 is a schematic sectional view through the righthand freely protruding end of the lamella and of the support thereof with respect to the guide traverse.
Figure 4:
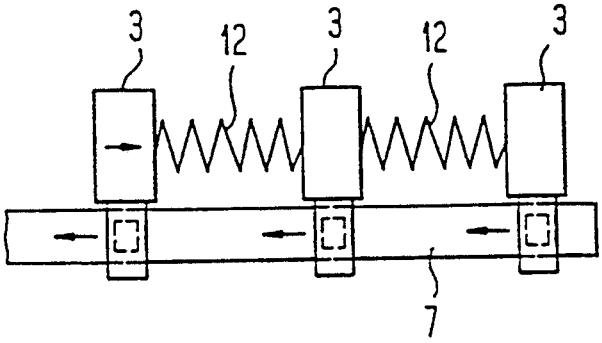
FIG. 4 is a schematic lateral view of three lamellae disposed next to each other with control springs acting between them.

In the above two cases of the parallel arrangement of the guide traverse 7 or the diagonal arrangement of the guide traverse 7, respectively, the lamellae are guided via thrust sliding bearings 13 (see FIG. 3) or 14 (see FIG. 6), respectively, which are laterally supported at the guide traverse 7 for taking up the reaction forces occurring at the inclined traverse supports 8 and acting in the longitudinal direction of the lamellae 3. In order to obtain a component acting in the direction of control from these reaction forces directed at right angles to the guide traverse 7, the guide traverse 7 may—as described above—be arranged diagonally opposite to the inclined traverses 4, 5, 6. However, the guide traverse may basically also be arranged parallel to the inclined traverses, wherein an additional control mechanism (such as an elastic control or a rod control) must be provided for in the area of the guide traverse, the control forces of said control mechanism overcoming the forces of the guide traverse acting in the opposite, "wrong" direction. In this case, it would even be possible to arrange all inclined traverses and the guide traverse parallel to each other.

Figure 5:
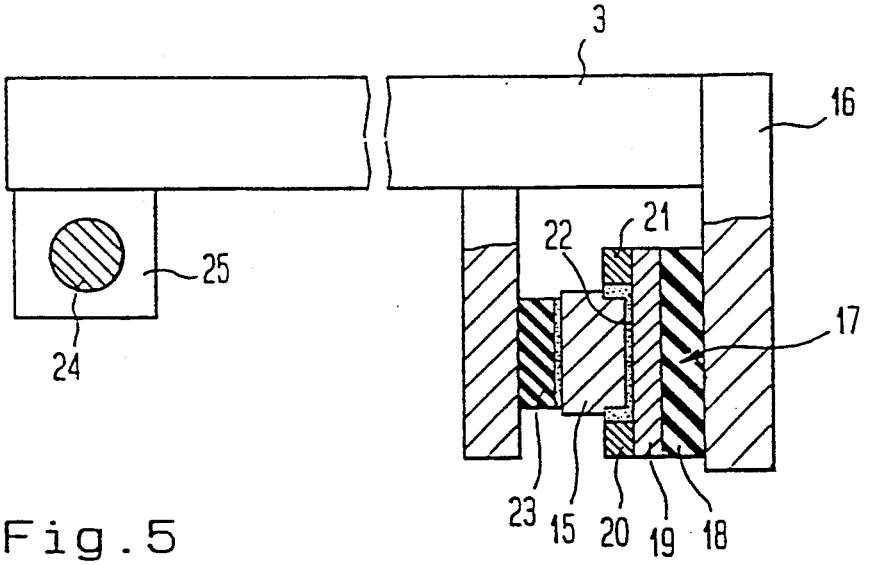
FIG. 5 is a schematic sectional view similar to FIG. 3 in which the thrust sliding bearing is in the form of a moulding bearing.

In order to prevent the protruding ends of the lamellae 3 from being bent upwards in a vertical direction, an arrangement described with reference to FIG. 5 is preferred, wherein the free ends of the lamellae are fixed in a moulding traverse 15 which simultaneously acts as a guide traverse. As can be seen, the free end of the lamella is provided with a stop 16 comprising a thrust sliding bearing 17 having an elastomer part 18 and a steel profile 19 having guide ledges 20, 21 attached thereto. The steel profile and the guide ledges are provided with sliding layers of PTFE 22 on the sliding surfaces thereof opposing the moulding traverse. The opposing flank of the guide traverse is also provided with a thrust sliding bearing 23. The tensile or compressive forces resulting from the control forces and acting in the longitudinal direction of the lamellae are transmitted into the guide traverse via such thrust sliding bearings. The guide ledges 20, 21 at the same time prevent a vertical displacement of the lamellae to the upside. The same arrangement may be provided for on the opposing sides of the lamellae but it is sufficient if the control forces are only taken up on one side of the bridging construction by way of a guide traverse. Therefore, the embodiment according to FIG. 5 is provided with a moulding traverse 24 which per se is known and which reaches through a disk 25 arranged at the bottom of the lamella 3.

Figure 6:
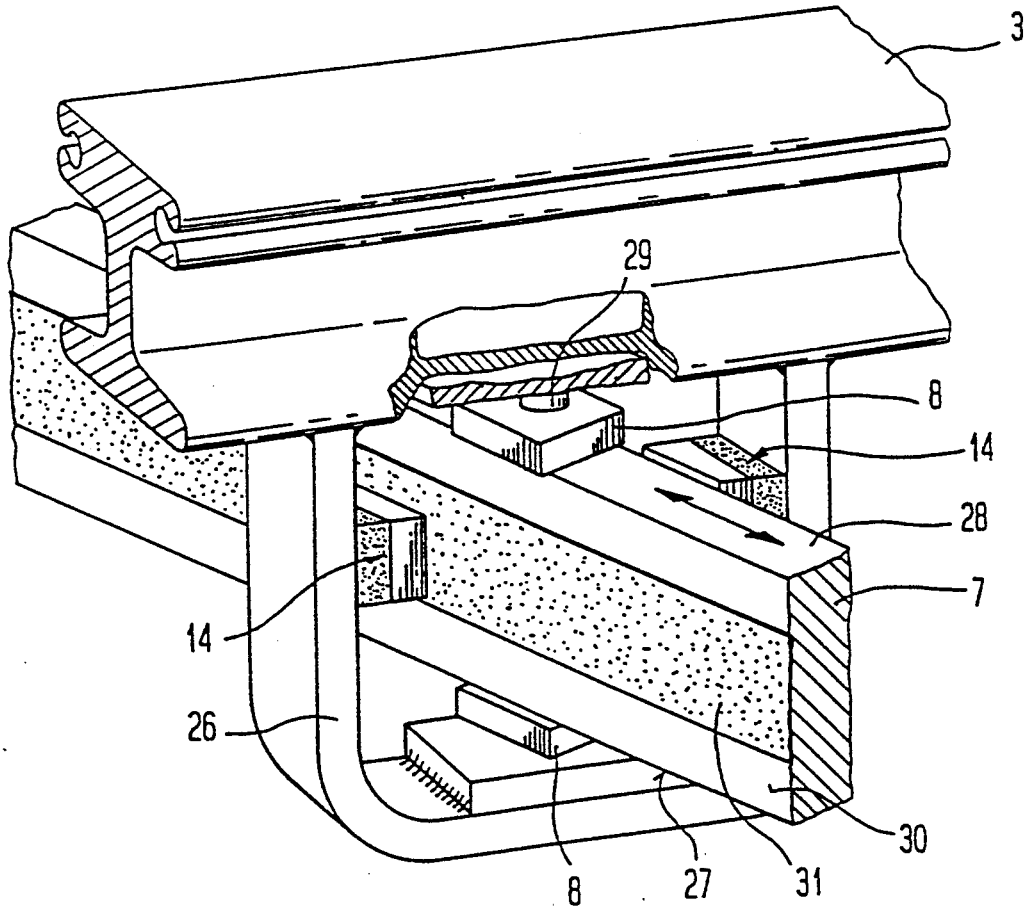
FIG. 6 is an embodiment alternative to FIG. 5.

An alternative embodiment is shown in FIG. 6, wherein a U-profile 26 in which the sliding drag bearing 8 or the thrust sliding bearing 14, respectively, are arranged is provided for below the lamella 3. It can furthermore be taken from FIG. 6 that the bottoms and the tops of the inclined traverses are movably guided between the grooves of a lower and an upper bearing body 8. Such bearing bodies comprise essentially disk-shaped projections which are pivoted in corresponding recesses at the lamella or the bow bottom, respectively. The sliding drag bearings are inserted in a vertically pre-stressed condition in order to prevent the traverses from lifting off the bearings. The inclined traverses are supported with sliding drag bearings in the traverse boxes in the same manner and their ends comprise stops in order to prevent them from sliding out of their bearings at the joint edges.

In the alternative embodiment shown in FIG. 6, the bottom 27 and the top 28 of the guide traverse 7 are guided between square bearing plates into which corresponding grooves have been milled. These bearing plates can additionally be pivoted—as in the case of the sliding drag bearings—with the aid of disk-shaped cams 29 at the lamella bottom or bow bottom, respectively, if the guide traverse 7 does not extend in the direction of movement of the superstructure. If it is arranged in the direction of movement of the superstructure, a rotatable support can be dispensed with altogether as the guide traverse 7 does not undergo any rotations relative to the lamella. The embodiment shown includes a guide traverse 7 which is diagonal to the direction of movement of the bridge superstructure 1. It can also be seen from FIG. 6 that the thrust sliding bearings 14 between which the two side faces 30 of the guide traverse 7 are guided without play is provided with sliding foil 31 for reducing the friction.

Due to the fact that the lamellae are guided at the guide traverse 7 through the thrust sliding bearing 14, large tensile and compressive forces acting in the longitudinal direction of the lamellae can be received, which is necessary as all forces introduced via the inclined traverses, acting in the longitudinal direction of the lamellae and inevitably occurring as a result of the horizontal wheel loads from the traffic or during movements of the superstructure due to the diagonal arrangement of the inclined traverses have to be taken up by the guide traverse. Therefore, the cross-section of the guide traverse is also adapted to the lateral loads. A corresponding, sufficiently dimensioned reception with laterally guided sliding bearings is provided for both ends of the guide traverse in the traverse boxes.

The above arrangement of the inclined traverses and the guide traverse or guide traverses, respectively, proves to be advantageous in so far as the support widths of the parallel lamellae are constant in the trafficable area. The reinforcement of individual lamellae having enlarged support widths which has been required so far in the swivel traverse solution can be dispensed with. The possibility of arranging the inclined traverses in a more acute angle relative to the lamella results in an improvement of the control behaviour. In the alternately diagonal arrangement of the traverses relative to the lamellae, the acute angle is limited due to the support width of the lamellae varying considerably in the event of an increasing inclination of two neighbouring traverses in this traverse field. There is no such limitation in the case of a parallel arrangement of the inclined traverses. If the joint edge moves in such manner that the joint is closing, control forces are generated at the support points of the lamellae on the traverses due to the avertence of the traverses about a pivot arranged, for example, in a joint edge and having a vertical axis of rotation, said control forces displacing the lamellae towards the closing direction of the joint on the traverses. These forces are counteracted by frictional forces between the lateral steps of the sliding bearing and the lateral wall of the inclined traverses.

What is claimed:

1. A device for bridging expansion joints in bridges or the like having a superstructure, said device comprising lamellae which extend at right angles to the longitudinal axis of the traffic route and are supported on traverses which are pivoted and/or movably supported in the joint edges and bridge the joints, wherein said traverses are in the form of inclined traverses extending diagonally with respect to the direction of displacement of the superstructure and being arranged parallel to each other, and control means are provided, said control means comprising at least one guide traverse in addition to said inclined traverses, said control means functioning to counteract movement of the lamellae in a longitudinal direction thereof lamellae as a result of horizontal traffic wheel loads or during a movement of the superstructure, respectively.

2. A device according to claim 1, wherein said control means further comprises an elastic control.

3. A device according to claim 2, wherein said elastic control is made up of a profile in the form of a dual seal tube.

4. A device according to claim 3, wherein said dual seal tube is provided with an inside ribbing.

5. A device according to claim 3 or 4, wherein said dual seal tube is made of chloroprene.

6. A device according to claim 1, wherein said control means further comprises a rod control.

7. A device according to claim 1, wherein protruding lamella ends are horizontally resistant to bending in order to transmit control forces from said at least one inclined traverses to said guide traverse.

8. A device according to claim 8, wherein said guide traverse is disposed near said protruding lamella ends, said guide traverse extending in the direction of displacement of said superstructure.

9. A device according to claim 7, wherein said guide traverse extends in a direction different from and opposite to the diagonal extension direction of said inclined traverses.

10. A device according to claim 7, wherein said guide traverse is arranged in the same direction as said inclined traverses, and parallel thereto.

11. A device according to claim 7, wherein said guide traverse further comprises a thrust sliding bearing arranged in a U-shaped bow at the bottom of said respective lamellae at both sides of said guide traverse.

12. A device according to claim 11, wherein said thrust sliding bearing is arranged at side faces of said guide traverse.

13. A device according to claim 11, wherein said guide traverse further comprises an additional guide acting at right angles to the longitudinal direction thereof.

14. A device according to any one of claims 8, 9, 10 or 13, wherein side faces of said guide traverse are provided with a sliding layer.

15. A device according to claim 14, wherein said sliding layer comprises a steel sheet arranged on said side face of said guide traverse.

16. A device according to claim 11, wherein at least one thrust sliding bearing is provided at each support point lamella/guide traverse.

17. A device according to claim 16, wherein a contact surface of each thrust sliding bearing is coated with PTFE.

18. A device according to claim 1 or 17 wherein each of two lateral ends of the joint is provided with a guide traverse, and thrust sliding bearings are only provided for at an outside of each of said guide traverses.

19. A device according to claim 7, wherein a means safeguarding the protruding end of said lamella from vertical displacement is provided for between said guide traverse and each lamella.

20. A device according to claim 19, wherein said means safeguarding the protruding ends of said lamella comprise sliding bearings arranged at a top and a bottom of said guide traverse and provided for in a bow below said lamella.

21. A device according to claim 19, wherein said means safeguarding the protruding ends of said lamella comprise thrust sliding bearings, tops of which are provided with the guide traverse, and bottoms of which are provided with encompassing guide ledges.

* * * * *